US005593809A

United States Patent [19]

Kim et al.

[11] Patent Number: 5,593,809

[45] Date of Patent: Jan. 14, 1997

[54] PEEL APART DIFFUSION TRANSFER COMPOUND FILM UNIT WITH CROSSLINKABLE LAYER AND BORATE

[75] Inventors: Gia Y. Kim, Laverne, Calif.; Lloyd D. Taylor, Lexington; Kenneth C. Waterman, Concord, both of Mass.

[73] Assignee: Polaroid Corporation, Cambridge, Mass.

[21] Appl. No.: 568,964

[22] Filed: Dec. 7, 1995

[51] Int. Cl.[6] ..... G03C 8/26; G03C 8/28; G03C 8/56; G03C 8/50

[52] U.S. Cl. ..... 430/213; 430/215; 430/216; 430/232; 430/227; 430/237; 430/236; 430/238; 430/244; 430/248; 430/249; 430/262; 430/263

[58] Field of Search ..... 430/213, 215, 430/216, 232, 237, 248, 249, 262, 263, 236, 238, 244, 227

[56] References Cited

U.S. PATENT DOCUMENTS

| | | | |
|---|---|---|---|
| 3,239,338 | 3/1966 | Rogers | 96/29 |
| 3,295,970 | 1/1967 | Rogers | 430/215 |
| 3,620,728 | 12/1969 | Cottingham | 96/29 |
| 3,679,409 | 7/1972 | Buckler et al. | 430/215 |
| 3,880,658 | 11/1972 | Lestina et al. | 96/29 |
| 3,990,895 | 11/1976 | Land | 96/25 |
| 4,168,166 | 4/1978 | Land | 96/3 |
| 4,324,853 | 4/1982 | Berger | 430/245 |
| 4,343,886 | 8/1982 | Nakamura et al. | 430/237 |
| 4,629,677 | 12/1986 | Katoh | 430/215 |
| 5,176,984 | 1/1993 | Hipps, Sr. et al. | 430/281 |
| 5,200,292 | 4/1993 | Shinozaki et al. | 430/178 |
| 5,246,818 | 9/1993 | Liu | 430/326 |
| 5,260,180 | 11/1993 | Sahyun et al. | 430/542 |
| 5,342,729 | 8/1994 | Aono | 430/203 |
| 5,346,800 | 9/1994 | Foley et al. | 430/213 |
| 5,415,969 | 5/1995 | Waterman | 430/215 |

FOREIGN PATENT DOCUMENTS 05165140 6/1993 Japan .

*Primary Examiner*—Richard L. Schilling
*Attorney, Agent, or Firm*—Gaetano D. Maccarone

[57] ABSTRACT

There are described a diffusion transfer photographic film unit of the type wherein an image-receiving element is designed to be separated from a photosensitive element after photoexposure and processing and a photographic process which utilizes the film unit. The photographic film unit comprises a photosensitive element including a support carrying at least one silver halide emulsion, an image-receiving element comprising a support, an image-receiving layer and, optionally, an overcoat layer and/or a strip-coat layer. At least one of the image-receiving layer, overcoat layer or strip-coat layer includes a "crosslinkable material" which is crosslinked during processing. The film unit further includes means for providing an aqueous alkaline processing composition to the photosensitive element and the image-receiving element for developing an image. The aqueous alkaline processing composition includes a borate compound for crosslinking the crosslinkable material of the image-receiving element during processing.

26 Claims, 1 Drawing Sheet

PEEL APART DIFFUSION TRANSFER COMPOUND FILM UNIT WITH CROSSLINKABLE LAYER AND BORATE

BACKGROUND OF THE INVENTION

This invention relates to diffusion transfer photographic film units and processes of the type wherein an image-receiving element is designed to be separated from a photosensitive element after photoexposure and processing. Such film units are well known and are often referred to as instant "peel apart" photographic film units. Various embodiments of "peel apart" film units are known and include those wherein images are formed in black and white (reduced silver), and color (image dyes), as described in: E. H. Land, H. G. Rogers, and V. K. Walworth, in J. M. Sturge, ed., *Neblette's Handbook of Photography and Reprography*, 7th ed., Van Nostrand Reinhold, New York, 1977, pp. 258–330; and V. K. Walworth and S. H. Mervis, in J. Sturge, V. Walworth, and A. Shepp, eds., *Imaging Processes and Materials: Neblette's Eighth Edition*, Van Nostrand Reinhold, New York, 1989, pp. 181–225. Additional examples of peel apart film units are described in U.S. Pat. Nos. 2,983,606; 3,345,163; 3,362,819; 3,594,164; and 3,594,165.

In general, diffusion transfer photographic products and processes involve film units having a photosensitive element including a support carrying at least one silver halide emulsion, and an image-receiving element including a support and an image-receiving layer. After photoexposure, the photosensitive element is developed, generally by uniformly distributing an aqueous alkaline processing composition over the photoexposed element, to establish an imagewise distribution of a diffusible image-providing material. The image-providing material, typically image dyes or complexed silver, is selectively transferred, at least in part, by diffusion to the image-receiving layer positioned in a superposed relationship with the developed photosensitive element. The image-receiving layer is capable of mordanting or otherwise fixing the image-providing material and retains the transferred image for viewing. The image is viewed in the image-receiving layer upon separation of the image-receiving element from the photosensitive element after a suitable imbibition period.

In order to facilitate the separation of the image-receiving element from the photosensitive element after photographic processing, and to prevent the processing solution from remaining on the image-receiving element, it is common to utilize a strip-coat positioned between the photosensitive and image-receiving elements. An example of such a strip-coat is disclosed in U.S. Pat. No. 5,346,800 to Foley et al.

After processing and upon separation of the image-receiving element from the photosensitive element, the surface of the image-receiving element often remains tacky for some time period thereafter. During this time period care must be exercised in the handling of the photograph so as not to damage it. Furthermore, in instances where it is desired to place the photograph in a holder or envelope for storage purposes, or to stack photographs on top of each other, it is necessary to wait until the surface of the photograph is sufficiently tack-free to permit handling in such a manner. The time period required to allow such handling varies depending upon various factors such as the amount of liquid taken up by the image-receiving layer during photographic processing and the ambient relative humidity and temperature. Additionally, at any time after processing and drying the photograph may encounter humid conditions which can render the surface of the photograph tacky.

Various efforts have been made to remedy the aforementioned shortcomings. For example, U.S. Pat. No. 5,415,969 (and CIP application Ser. No. 08/382,880 filed Feb. 2, 1995) of Kenneth C. Waterman disclose the use of an image-receiving element including a overcoat layer comprising a majority of colloidal particles, e.g. silica, and a minority of binder material for reducing the time period that the surface of the image-receiving layer remains tacky after processing and separation from the photosensitive element.

It is generally understood that various materials within the image-receiving element may be crosslinked. For example, it is known to include crosslinking agents such as aldehydes (dialdehydes, aldehyde precursors, e.g. dantoin™), zwitterion™ from Dow Chemical, and diepoxides within the image-receiving element in order to crosslink materials, e.g. gelatin, therein. As a specific example, U.S. Pat. No. 4,629,677 to Katoh discloses a strip-coat comprising a crosslinked copolymer containing more than 40 mole % of a monomer unit derived from an ethylenically unsaturated carboxylic acid or a salt thereof.

As an additional example, U.S. Pat. No. 5,342,729 to Aono discloses an image-receiving element including in sequence; a support, an image dye receiving layer and a protective layer. The protective layer includes a water-soluble polymer having repeating units containing at least a hydroxyl group and/or a carboxyl group or salts thereof. The image-receiving element further includes a borate compound which is present in the protective layer and/or diffuses to the protective layer from an adjacent layer after coating for reducing contact dye transfer. The preferred embodiment is a thermal system wherein heat is applied during processing in order to develop an image. In such thermally processed systems, very little if any water and/or processing composition is used. As such, the image-receiving element does not typically absorb an appreciable amount of liquid and thus become tacky. Consequently, problems associated with tackiness are less prevalent in such thermal systems.

U.S. Pat. No. 3,239,338 to Rogers describes an image-receiving element having an image-receiving layer comprising polyvinylalcohol or derivatives thereof wherein borate ions are used to reduce the water-sensitivity of the image-receiving layer prior to processing.

It is noted that a drawback of providing a borate compound within the image-receiving element prior to processing is that the borate compound can crosslink materials within the element, e.g. the image-receiving layer, protective layer, etc., prior to processing, i.e. during coating and/or during storage. Once crosslinked, the materials within the layer do not swell (or at least do not swell to the same degree) when contacted with the processing composition. As a result, the image density of the resulting photograph is typically reduced as permeation of image-providing material through such crosslinked materials is significantly less than through similar non-crosslinked materials.

U.S. Pat. No. 3,239,338 to Rogers also describes the application of borate ions to a processed image-receiving element having polyvinyl alcohol copolymers or derivatives, by way of swabbing an aqueous solution including borate ions upon the post-processed image-receiving element.

With respect to other uses of borate compounds, U.S. Pat. Nos. 4,168,166 to Land and 4,324,853 to Berger both describe processing compositions for use in diffusion transfer photographic film units which include a borate compound for inhibiting crystal formation, or salting out, of one or more of the processing composition constituents. Tackiness problems of the image-receiving element are not addressed however.

It is desired to design a diffusion transfer peel apart photographic film unit wherein the image-receiving element can be separated from the photosensitive element following processing with reduced tack. Furthermore, it is desired to accomplish this result without significantly reducing image density.

SUMMARY OF THE INVENTION

The present invention is directed to a "peel-apart" type photographic film unit and a method for forming a diffusion transfer photographic image using the film unit. The photographic film unit of the invention comprises a photosensitive element including a support carrying at least one silver halide emulsion, and an image-receiving element comprising in sequence: a support, an image-receiving layer and optionally an overcoat layer and/or a strip-coat layer. At least one of the image-receiving layer, overcoat layer and strip-coat layer includes a crosslinkable material which is crosslinked during processing. The film unit also includes means for providing an aqueous alkaline processing composition to the photosensitive element and the image-receiving element for developing an image. The aqueous alkaline processing composition includes a borate compound for crosslinking the crosslinkable material of the image-receiving element during processing.

By crosslinking materials within the image-receiving layer and/or an overcoat layer or strip-coat layer, the outer surface of the image-receiving element is rendered relatively tack-free after processing and separation from the photosensitive element. Furthermore, by crosslinking materials within the image-receiving layer and/or an overcoat layer or strip-coat layer during processing instead of prior to processing, the image density of the resulting photograph is relatively greater.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DETAILED DESCRIPTION OF THE PREFERRED EMBODIMENTS

The present invention relates to diffusion transfer photographic film units and processes of the type wherein a photographic processing composition is provided to a photosensitive element and an image-receiving element for initiating development of a photographic image. Furthermore, the present invention is directed toward such film units wherein the image-receiving element is designed to be separated from the photosensitive element after processing.

As will be described in detail below, the subject image-receiving element comprises in sequence, a support, an image-receiving layer, and optionally, one or more overcoat layers. In one preferred embodiment, the image-receiving layer does not include an overcoat layer. In such an embodiment, the image-receiving layer includes a "crosslinkable material" which is crosslinked during processing by a borate compound disposed within the processing composition. In other embodiments of the invention, one or more overcoat layers may be utilized over the image-receiving layer, provided, however, that at least one of the image-receiving layer or overcoat layer(s) includes a crosslinkable material which is crosslinked during processing.

Figure 1:
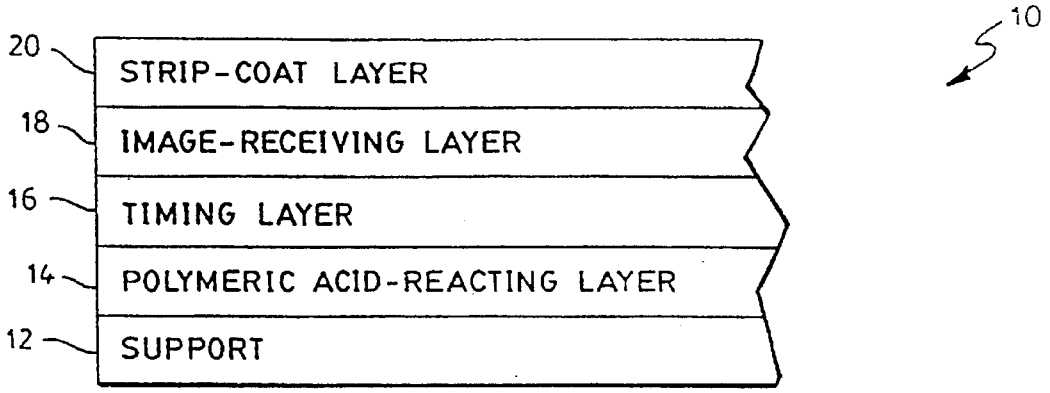
FIG. 1 is a partially schematic, cross-sectional view of one embodiment of an image-receiving element according to the invention.

With reference to FIG. 1, a preferred image-receiving element specifically adapted for use in a photographic "peel apart" film unit is generally shown at 10 comprising a support 12 carrying a polymeric acid-reacting layer 14, a timing (or spacer) layer 16, an image-receiving layer 18 and an overcoat layer 20. Each of the layers carried by support 12 functions in a predetermined manner to provide desired diffusion transfer processing and is described in detail hereinafter. It is to be understood that the image-receiving element of the photographic diffusion transfer film units of the present invention may include additional layers as is known in the art.

Support material 12 can comprise any of a variety of materials capable of carrying layers 14, 16, 18, and 20, as shown in FIG. 1. Paper, vinyl chloride polymers, polyamides such as nylon, polyesters such as polyethylene terephthalate, or cellulose derivatives such as cellulose acetate or cellulose acetatebutyrate, can be suitably employed. Depending upon the desired nature of the finished photograph, the nature of support material 12 as a transparent, opaque or translucent material will be a matter of choice. Typically, an image-receiving element adapted to be used in peel-apart diffusion transfer film units and designed to be separated after processing will be based upon an opaque support material 12. While support material 12 of image-receiving element 10 will preferably be an opaque material for production of a photographic reflection print, it will be appreciated that support 12 will be a transparent support material where the processing of a photographic transparency is desired. In one embodiment where support material 12 is a transparent sheet material, an opaque sheet (not shown), preferably pressure-sensitive, can be applied over the transparent support to permit in-light development. Upon photographic processing and subsequent removal of the opaque pressure-sensitive sheet, the photographic image diffused into image-receiving layer 20 can be viewed as a transparency. In another embodiment where support material 12 is a transparent sheet, opacification materials such as carbon black and titanium dioxide can be incorporated in the processing composition to permit in-light development.

Figure 2:
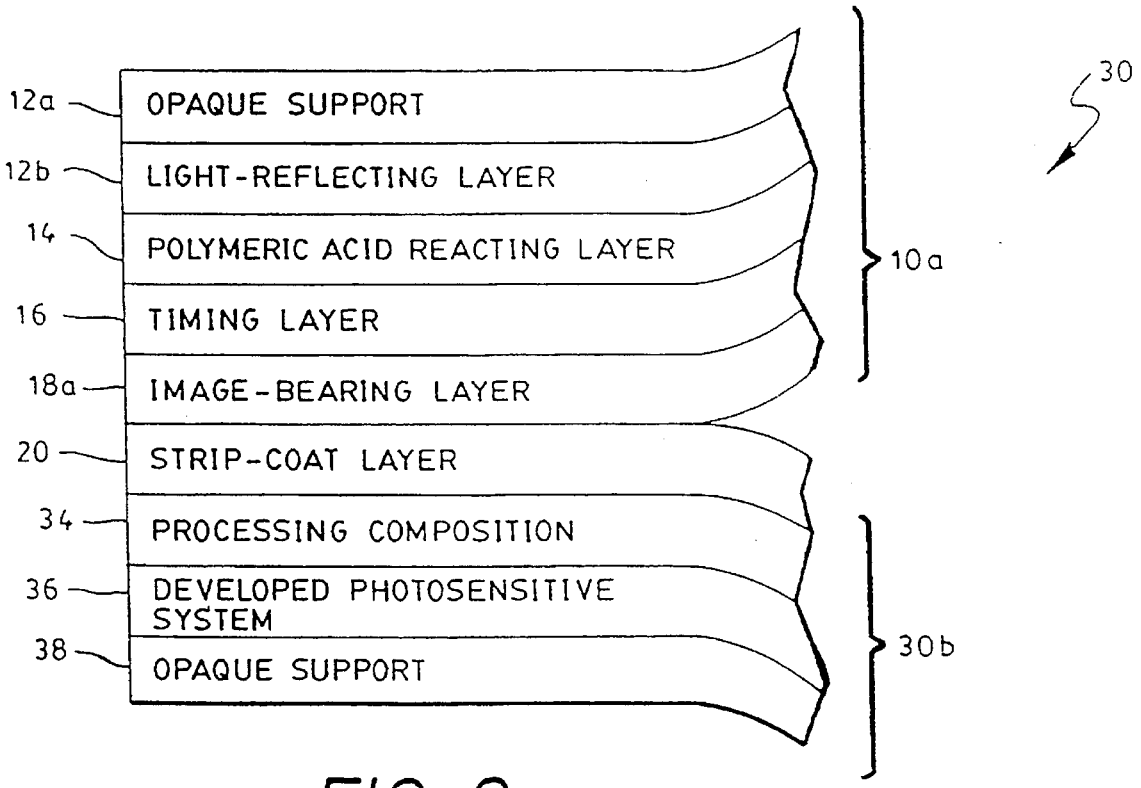
FIG. 2 is a partially schematic, cross-sectional view of a photographic film unit according to the invention, shown after exposure and processing.

With reference to FIG. 2, a diffusion transfer peel apart type film unit according to the present invention is generally shown at 30. The film unit 30 includes a photoexposed photosensitive element **30*b* comprising a processing composition layer 34, a developable photosensitive system 36 and an opaque support 38. The film unit 30 is shown alter photographic processing and prior to separation of an image-receiving element 10*a* from a processed photosensitive element 30*b*. Prior to processing, the processing composition 34** is typically contained within a pressure-rupturable pod, as is common in the art. Such pods and like structures are common in the art and generally define the means for providing the processing composition to the photosensitive element and image-receiving element. The processing composition typically comprises an aqueous alkaline solution including a developing agent and other addenda as is known in the art. Examples of such processing compositions are found in the following U.S. Pat. Nos. and the patents cited therein: 4,756,996; 3,455,685; 3,597,197; 4,680,247 and 5,422,233.

The processing composition utilized in the diffusion transfer film units of the present invention further includes a borate compound capable of crosslinking a crosslinkable material within the image-receiving layer and/or overcoat layer(s) during processing. Examples of such borate materials are described in *Kirk-Othmer Encyclopedia of Chemical Technology,* 3rd Edition, Volume 4, John Wiley & Sons, Inc., 1978, pp. 67–123. The subject "crosslinkable" material will be described in detail below. Although the selection of a particular borate compound for use in a film element will depend upon the specific crosslinkable material used in the image-receiving layer and/or overcoat layer(s), borate compounds including at least one of the materials represented below are preferred:

(a) $H_3BO_3$; and (b) $xM_2O \bullet yB_2O_3 \bullet zH_2O$;

wherein M represents a monovalent cation, x and y each represents a positive integer, and z represents zero or a positive integer. Particularly preferred borate compounds include boric acid ($H_3BO_3$), sodium borate ($Na_2\ B_2O_7\ 10H_2O$), and potassium borate ($K_2\ B_2O_7\ 10H_2O$). The described borate compounds may be used alone or in various combinations with one another and typically make up between about 0.2% to 1.5% by weight of the processing composition. If higher amounts of borate are used, the image density of the photograph may be significantly reduced whereas if lesser amounts are used, tackiness may not be reduced enough. Although the specific amount used will vary depending upon the specific photographic system used, in a preferred embodiment of the subject invention, approximately 1.0% by weight of the processing composition is sodium borate. Another preferred embodiment of the subject invention utilizes a processing composition which is approximately 0.85% by weight of boric acid. Those skilled in the art will appreciate that the optimum amount of borate compound used within a particular system may be determined through routine scoping experiments.

In one embodiment of the invention, a relatively small percentage of the total amount of borate compound present in the film unit may be disposed in the image-receiving element prior to processing, e.g. in the image-receiving layer or in an overcoat layer, provided that the particular borate compound itself and/or the amount present in the image-receiving element does not react with any crosslinkable material in that element prior to application of the photographic processing composition during photographic processing. For example, boric acid can be initially provided in the image-receiving layer at low levels, e.g., less than about 100 mg/m$^2$, without cross-linking materials such as polyvinylalcohol. Boric acid typically will not react with polyvinylalcohol other than at the elevated pH levels present during photographic processing. It has been found that other borate compounds, e.g., borax and sodium borate, will react with polyvinylalcohol at lower pH levels. By incorporating some of the total amount of borate compound in the film unit in the image-receiving element, the concentration of anions added to the processing composition to compensate for the borate compound incorporated therein can be reduced.

The photosensitive system 36 comprises a photosensitive silver halide emulsion. In a preferred color embodiment of the invention, the photosensitive silver halide emulsion includes a corresponding diffusible dye, which upon processing is capable of diffusing to the image-receiving layer 18 as a function of exposure. In a preferred black & white embodiment of the invention, the image-forming material utilized is complexed silver which diffuses from the photosensitive element to the image-receiving layer during processing. Both such photosensitive systems are well known in the art and will be described in more detail hereinafter.

In further reference to FIG. 2, an image-receiving element 10*a* is generally shown, including layers 12*a*, 12*b*, 14, 16, 18*a* and 20. In this illustrative embodiment, image-receiving element 10*a* includes opaque support 12*a*. The support may comprise an opaque support material 12*a*, such as paper, carrying a light-reflecting layer 12*b* thereon. On separation of the image-bearing photograph 10*a*, the image in image-bearing layer 18*a* can be viewed against light-reflecting layer 12*b*. Light-reflecting layer 12*b* can comprise, for example, a polymeric matrix containing a suitable white pigment material, e.g., titanium dioxide.

In a preferred embodiment, the photographic diffusion transfer film units of the invention are intended to provide multicolor dye images and the image-receiving elements used in such film units are especially adapted for use in such film units. The most commonly employed negative components for forming multicolor images are of the "tripack" structure and contain blue-, green-, and red-sensitive silver halide emulsion layers, each having associated therewith in the same or in a contiguous layer a yellow, a magenta and a cyan image dye-providing material, respectively. Suitable photosensitive elements and their use in the processing of diffusion transfer photographs are well known and are disclosed, for example, in U.S. Pat. No. 3,345,163 (issued Oct. 3, 1967 to E. H. Land, et al.); in U.S. Pat. No. 2,983,606 (issued May 9, 1961 to H. G. Rogers); and in U.S. Pat. No. 4,322,489 (issued Mar. 30, 1982 to E. H. Land, et al.). Photosensitive elements which include dye developers and a dye-providing thiazolidine compound can be used with good results and are described in U.S. Pat. No. 4,740,448 to P. O. Kliem.

In the embodiments illustrated in FIGS. 1 and 2, the image-receiving element 10, 10*a* includes a polymeric acid-reacting layer 14. The polymeric acidreacting layer 14 reduces the environmental pH of the film unit, subsequent to transfer image formation. As disclosed, for example, in the previously referenced U.S. Pat. No. 3,362,819, the polymeric acid-reacting layer may comprise a nondiffusible acid-reacting reagent adapted to lower the pH from the first (high) pH of the processing composition in which the image material (e.g. image dyes) is diffusible to a second (lower) pH at which they are not diffusible. The acid-reacting reagent is preferably a polymer which contains acid groups, e.g., carboxylic acid or sulfonic acid groups, which are capable of forming salts with alkaline metals or with organic bases, or potentially acid-yielding groups such as anhydrides or lactones. Thus, reduction in the environmental pH of the film unit is achieved by the conduct of a neutralization reaction between the alkali provided by the processing composition and layer 14 which comprises immobilized acid-reactive sites and which functions as a neutralization layer. Preferred polymers for neutralization layer 14 comprise such polymeric acids as cellulose acetate hydrogen phthalate; polyvinyl hydrogen phthalate; polyacrylic acid; polystyrene sulfonic acid; and maleic anhydride copolymers and half esters thereof.

Polymeric acid-reacting layer 14 can be applied, if desired, by coating support layer 12 with an organic solvent-based or water-based coating composition. A polymeric acid-reacting layer which is typically coated from an organic-based composition comprises a mixture of a half butyl ester of polyethylene/maleic anhydride copolymer with polyvinyl butyral. A suitable water-based composition for the provision of polymeric acid-reacting layer 14 comprises a mixture of a water soluble polymeric acid and a water soluble matrix, or binder, material. Suitable water-soluble polymeric acids include ethylene/maleic anhydride copolymers and poly(methyl vinyl ether/maleic anhydride). Suitable water-soluble binders include polymeric materials such as polyvinyl alcohol, partially hydrolyzed polyvinyl acetate, carboxymethyl cellulose, hydroxyethyl cellulose, hydroxypropyl cellulose, polymethylvinylether or the like, as described in U.S. Pat. No. 3,756,815. As examples of useful polymeric acid-reacting layers, in addition to those disclosed in the aforementioned U.S. Pat. Nos. 3,362,819 and 3,756,815, mention may be made of those disclosed in the following U.S. Pat. Nos.: 3,765,885; 3,819,371; 3,833,367 and 3,754,910. A preferred polymeric acid-reacting layer 14 comprises a free acid of a copolymer of methyl vinyl ether and maleic anhydride and a vinyl acetate ethylene latex.

Timing layer 16 controls the initiation and the rate of capture of alkali by the acid-reacting polymer layer 14. The timing layer 16 may be designed to operate in a number of ways. For example, the timing layer 16 may act as a sieve, slowly metering the flow of alkali there through. Alternatively, the timing layer 16 may serve a "hold and release" function; that is the timing layer 16 may serve as an alkali impermeable barrier for a predetermined time interval before converting in a rapid and quantitatively substantial fashion to a relatively alkali permeable condition, upon the occurrence of a predetermined chemical reaction. Examples of suitable materials for use as timing layers are described in U.S. Pat. Nos. 3,575,701; 4,201,587; 4,288,523; 4,297,431; 4,391,895; 4,426,481; 4,458,001; 4,461,824 and 4,547,451. As described in these patents, timing layers having the previously described characteristics can be prepared from polymers which comprise repeating units derived from polymerizable monomeric compounds containing groups which undergo a predetermined chemical reaction as a function of contact with alkali and which are then rendered permeable to alkali. Monomeric compounds which are capable of undergoing a beta-elimination or which undergo an hydrolytic degradation after a predetermined period of impermeability to alkali can be employed in the production of suitable polymeric timing layer materials.

Polymeric materials suitable for the production of timing layer 16 will typically be copolymers comprising repeating units of the previously described type (i.e., repeating units derived from polymerizable monomers capable of undergoing an alkali-initiated chemical reaction after a predetermined "hold" time interval) and comonomeric units incorporated into the polymer to impart thereto predetermined properties. For example, the "hold time", i.e., the time interval during which timing layer 16 remains impermeable to alkali during processing, can be affected by the relative hydrophilicity of the layer resulting from incorporation of a given comonomer or mixture of comonomers into the timing layer polymer. In general, the more hydrophobic the polymer, the slower will be the rate of permeation of alkali into the timing layer to initiate the alkali-activated chemical reaction, i.e., the longer the alkali hold time. Alternatively, adjustment of the hydrophobic/hydrophilic balance of the polymer by inclusion of appropriate comonomeric units may be used to impart predetermined permeability characteristics to a timing layer as appropriate for a given usage within a film unit.

The predetermined hold time of timing layer 16 can be adjusted as appropriate for a given photographic process by means such as controlling the molar ratio or proportion of repeating units which undergo the desired alkali-initiated chemical reaction; altering the thickness of the timing layer; incorporation of appropriate comonomeric units into the polymeric to impart thereto a desired hydrophobic/hydrophilic balance or degree of coalescence; using different activating groups to affect the initiation and rate of the alkali-initiated chemical reaction; or utilizing other materials, particularly polymeric materials, in the timing layer to modulate the permeation of alkali into timing layer 16, thereby altering the time necessary for initiation of the desired and predetermined chemical reaction. This latter means of adjusting the hold time of timing layer 16 may include, for example, utilization of a matrix polymer material having a predetermined permeability to alkali or aqueous alkaline processing composition as determined, for example, by the hydrophobic/hydrophilic balance or degree of coalescence thereof.

In general, increased permeability to alkali or aqueous alkaline processing composition, and thus, a shorter hold time, may be obtained by increasing the hydrophilicity of the matrix polymer or decreasing the degree of coalescence. Alternatively, decreased permeability of alkali or aqueous alkaline processing composition into timing layer 16 and, thus, a longer hold time, may be obtained by increasing the hydrophobicity of the matrix polymer or increasing the degree of coalescence.

Examples of suitable comonomers which can be used in the production of copolymeric materials suited to application in timing layer 16 include acrylic acid; methacrylic acid; 2-acrylamido-2-methylpropane sulfonic acid; N-methyl acrylamide; methacrylamide; ethyl acrylate; butyl acrylate; methyl methacrylate; N-methyl methacrylamide; N-ethyl acrylamide; N-methylolacrylamide; N,N-dimethyl acrylamide; N,N-dimethyl methacrylamide; N-(n-propyl)acrylamide; N-isopropyl acrylamide; N-(b-hydroxy ethyl)acrylamide, N-(b-dimethylaminoethyl)acrylamide; N-(t-butyl)acrylamide; N-[b-(dimethylamino)ethyl] methacrylamide; 2-[2'-(acrylamido)ethoxy]ethanol; N-(3'-methoxy propyl)acrylamide; 2-acrylamido-3-methol butyramide; acrylamido acetamide; methacrylamido acetamide; 2-[2-methacrylamido-3'-methyl butyramido]acetamide; and diacetone acrylamide.

Matrix polymer systems adapted to utilization in timing layer 16 can be prepared by physical mixing of the matrix polymer and the polymer containing the repeating units capable of undergoing alkali-initiated chemical reaction, or by the preparation of the timing layer polymer in the presence of a pre-formed matrix polymer. Polymers which may be used as matrix polymers will generally be copolymers which comprise comonomer units such as acrylic acid; methacrylic acid; methyl methacrylate; 2-acrylamido-2-methylpropane sulfonic acid; acrylamide; methacrylamide; N,N-dimethyl acrylamide; ethyl acrylate; butyl acrylate; diacetone acrylamide; acrylamido acetamide; methacrylamido acetamide.

In the production of copolymeric timing layer materials, and in the production of matrix polymers, the comonomeric units, as well as the ratios thereof, should be chosen on the basis of the physical characteristics desired in the matrix polymer and in the timing layer in which it is to be utilized.

Reference has been made to the utilization (in timing layers containing polymers capable of undergoing alkali-initiated chemical reaction) of other materials, particularly polymeric materials, to adjust the hold time of the timing layer in a predetermined manner and as appropriate for a given photographic process. It will be understood, however, that the presence in timing layer 16 of polymer or other materials which adversely affect or negate the desired alkali impermeable barrier properties of timing layer 16 is to be avoided. In this connection, it should be noted that gelatin, and particularly unhardened gelatin, is readily swollen and permeated by aqueous alkaline compositions typically employed in photographic processing. Accordingly, the presence in a timing layer of the invention of amounts of gelatin or other materials which promote rapid permeation of the layer by alkali and which effectively negate the hold character of the layer are to be avoided. Timing layer 16 is typically applied as a water-impermeable layer which results from the coalescence and drying of a coating composition, e.g., a latex composition.

The image-receiving layer 18 is designed for receiving an image-forming material which diffuses in an image-wise manner from the photosensitive element during processing. In color embodiments of the present invention, the image-receiving layer 18, 18*a* generally comprises a dyeable material which is permeable to the alkaline processing composition. The dyeable material may comprise polyvinyl alcohol together with a polyvinyl pyridine polymer such as poly(4-vinyl pyridine). Such image-receiving layers are further described in U.S. Pat. No. 3,148,061 to Howard C. Haas. Another image-receiving layer material comprises a graft copolymer of 4-vinyl pyridine and vinylbenzyltrimethylammonium chloride grafted onto hydroxyethyl cellulose. Such graft copolymers and their use as image-receiving layers are further described in U.S. Pat. Nos. 3,756,814 and 4,080,346 issued to Stanley F. Bedell. Other materials can, however, be employed. Suitable mordant materials of the vinylbenzyltrialkylammonium type are described, for example, in U.S. Pat. No. 3,770,439, issued to Lloyd D. Taylor. Mordant polymers of the hydrazinium type (such as polymeric mordants prepared by quaternization of polyvinylbenzyl chloride with a disubstituted asymmetric hydrazine) can be employed. Such mordants are described in Great Britain Pat. No. 1,022,207, published Mar. 9, 1966. One such hydrazinium mordant is poly(1-vinylbenzyl 1,1-dimethylhydrazinium chloride) which, for example, can be admixed with polyvinyl alcohol for provision of a suitable image-receiving layer.

In black and white embodiments of the invention, the image-forming material utilized is complexed silver which diffuses from the photosensitive element to the image-receiving layer during processing. The image-receiving layer utilized in such black and white embodiments typically includes silver nucleation materials, as is well known in the art.

In preferred embodiments of the invention, the image-receiving layer includes a crosslinkable material which is crosslinked by the previously described borate compound under processing conditions. The processing conditions typically comprise relatively high pH conditions, i.e. at a pH above 9, and preferably above 12. The terms "crosslink" and "crosslinkable" as used herein in connection with materials used together with the subject borate compounds are intended to describe a chemical reaction which takes place between the crosslinkable material and the borate compound under processing conditions and which results in the formation of a hydrogel. Suitable crosslinkable materials include polymers having functional groups which undergo crosslinking reactions under the conditions of photographic development with the previously described borate compounds. Examples of such crosslinkable materials include polymers having 1,2- or 1,3-hydroxyl groups, such as polyvinyl alcohol and its copolymers. Boratable polysaccharides such as guar, alginate, Kelzan and other members of the class which are often referred to as mannose gums can be utilized for this purpose. In boratable polysaccharides, some of the sugar rings have 1,2- or 1,3-hydroxyl groups which are cis to one another, thus permitting spatially the formation of a strong, cyclic borate complex. Guar gum contains boratable mannose cis glycol rings as well as a boratable galactose side chain. Alginate gums have rings made of boratable mannuronic acid as well as its boratable isomer, guluronic acid. Derivatives of these types of materials are also boratable, such as, for example, carboxymethylguar, hydroxyethyl guar and hydroxypropyl alginate.

The crosslinkable material may act as a mordant material, a binder material, or combination of both. For example, the mordant material may comprise a crosslinkable polyvinyl alcohol polymer with mordant polymer groups grafted thereto. In preferred embodiments, the crosslinkable material is binder material within the layer. By way of specific example, a preferred image-receiving layer comprises a polyvinyl alcohol binder (crosslinkable) material, and a mordant material comprising a copolymer including the following monomer units:

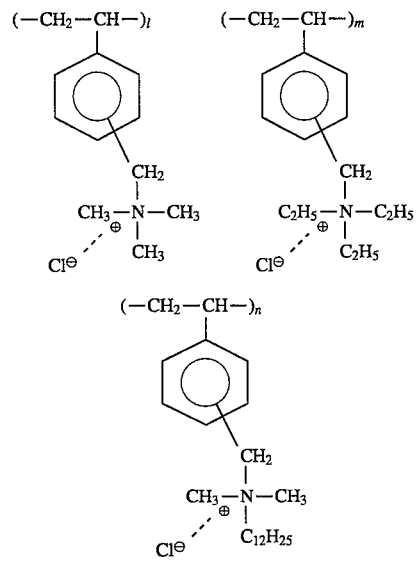

wherein l, m, and n represent the relative molar ratios of each monomer unit and are preferably 0.45, 0.45 and 0.1, respectively. Mordant materials of this type are disclosed in U.S. Pat. No. 4,794,067 to Grasshofl and Simon.

Sufficient crosslinkable material must be present in order to adequately crosslink with the borate compound and reduce the tackiness of the image-receiving element after photographic processing and separation of the photosensitive and image-receiving elements. The ratio of mordant to binder will depend upon the specific materials used. In the example just provided, a preferred ratio is from 1:1 to 10:1, but more preferably 2:1. Greater amounts of crosslinkable material typically reduce tackiness of the image-receiving layer following processing, but also typically reduce image density. Thus, it will be understood that routine experimentation is required to determine optimum ratios depending upon the specific materials and photographic system used.

As previously stated, the subject image-receiving element may include one or more overcoat layers overlying the image-receiving layer, so long as at least the image-receiving layer, or one of the overcoat layers includes the crosslinkable material previously described. Additionally, if the image-receiving layer does not include the previously described crosslinkable material, not only must at least one overcoat layer include such a crosslinkable material, but it is also important that a substantial portion of the overcoat layer remain with the image-receiving element after separation of the image-receiving element from the photosensitive element. This is necessary in order to offer the image-receiving element improved tack properties.

In reference to FIG. 2, a strip-coat layer (20) may be utilized for facilitating the separation of image-receiving element 10*a* from the photosensitive element 30*b*. For example, in photographic film unit 30 which is processed by distribution of an aqueous alkaline processing composition 34 between the image-receiving element 10*a* and a photo-exposed photosensitive element 30*b*, the strip-coat serves to facilitate separation of the photograph 10*a* from the developed photosensitive system 36, processing composition layer 34 and support 38 (collectively 30*b*).

Many materials have been disclosed in the art for use in strip-coat layers. Such a strip-coat can be prepared from a variety of hydrophilic colloid materials. Preferred hydrophilic colloids for a strip-coat include gum arabic, carboxymethyl cellulose, hydroxyethyl cellulose, carboxymethyl hydroxyethyl cellulose, cellulose acetatehydrogen phthalate, polyvinyl alcohol, polyvinyl pyrrolidone, methyl cellulose, ethyl cellulose, cellulose nitrate, sodium alginate, pectin, polymethacrylic acid, polymerized salts or alkyl, aryl and alkyl sulfonic acids (e.g., DAXAD™ available from the W. R. Grace Co.), polyoxyethylene polyoxypropylene block copolymers (e.g., PLURONIC™ F-127 available from the BASF Wyandotte Corp.) or the like. Further examples of materials for use in the subject strip coat include polymers derived from ethylenically unsaturated carboxylic acids or salts thereof, e.g. acrylic acid and acrylates e.g. butyl methacrylate, butyl acrylate, methyl methacrylate, hydroxy propyl methacrylate, hydroxy ethyl acrylate, etc.

An example of a strip-coat comprising a solution of hydrophilic colloid and ammonia is described in U.S. Pat. No. 4,009,031 and can be coated from an aqueous coating solution prepared by diluting concentrated ammonium hydroxide (about 28.7% $NH_4OH$) with water to the desired concentration, preferably from about 2% to about 8% by weight, and then adding to this solution an aqueous hydrophilic colloid solution having a total solids concentration in the range of about 1% to about 5% by weight. The coating solution also may include a small amount of a surfactant, for example, less than about 0.10% by weight of TRITON™ X-100, available from Rohm and Haas, Co., Phila., Pa. A preferred solution comprises about 3 parts by weight of ammonium hydroxide and about 2 parts by weight of gum arabic.

The strip-coat may also comprise a mixture of a hydrophilic colloid such as gum arabic and an aluminum salt such as aluminum lactate. An image-receiving element which includes a strip-coat comprising a hydrophilic colloid and an aluminum salt is disclosed and claimed in commonly-assigned U.S. Pat. No. 5,346,800 issued Sep. 13, 1994 to James A. Foley, Nicholas S. Hadzekyriakides and James J. Reardon.

When a strip-coat is present on the image-receiving element, materials within the strip-coat may be crosslinked prior to photographic processing, e.g. during coating of the layer. This is also true for materials within other layers of the image-receiving element. However, as noted previously, if such materials within the image-receiving layer or an overcoat layer or a strip-coat layer are crosslinked prior to processing, image density is typically reduced. Thus, if materials in any such layer(s) are to be crosslinked, they are preferably crosslinked during processing in accordance with the invention. For example, in one embodiment of the invention, the strip-coat includes a crosslinkable material which is substantially non-crosslinked prior to photographic processing but which undergoes a crosslinking reaction during processing when contacted with the borate compound within the subject processing composition, thus forming a hydrogel.

A particularly preferred strip-coat composition includes a copolymer of acrylic acid, hydroxy propyl methacrylate, and vinyl pyrrolidone, as described in detail in copending commonly-assigned patent application Ser. No. 08/568,937, filed on even date herewith. Although such a composition does not crosslink with the subject borate compound under processing conditions, an independent crosslinkable material may be added to the strip-coat for crosslinking purposes. Examples of such crosslinkable materials have been described above and include polymers having 1,2- or 1,3-hydroxyl groups, such as polyvinyl alcohol, and various copolymers of vinyl alcohol. By way of specific example, a preferred strip-coat overcoat includes a 60:40 ratio by weight of carboxymethyl guar to a copolymer comprising a 65:10:25 ratio of the following monomers: acrylic acid, hydroxy propyl methacrylate, and vinyl pyrrolidone.

As described previously, the image-receiving element may include an overcoat layer as described in U.S. Pat. No. 5,415,969 filed Oct. 6, 1993 (and CIP application Ser. No. 08/382,880), wherein water-insoluble particles are provided within binder material. Such an overcoat layer comprises a majority by dry weight of water-insoluble particles and a minority by dry weight of a binder material. The particles are substantially insoluble in water and non-swellable when wet. Furthermore, in order to minimize any light scatter by overcoat layer, the particles typically have a small average particle size, for example, less than 300 nm and preferably less than 100 nm, and more preferably in the range of about 1 nm to 50 nm. The water-insoluble particles may comprise inorganic materials, e.g. colloidal silica, and/or organic materials, e.g. water-insoluble polymeric latex particles such as an acrylic emulsion resin. Colloidal silica is the preferred inorganic particle for use in the subject overcoat layer, however, other inorganic particles may be used in combination or substituted therefor. An example of such an overcoat layer comprises water-insoluble polymeric latex particles, e.g. JONCYRL® 95 (available from SC Johnson Wax) and a water-insoluble latex polymer binder material, e.g. HYCAR® 26349, (a crosslinkable alkali swellable acrylate latex material available from the B.F. Goodrich Company, Specialty Polymers and Chemicals Division, Cleveland Ohio). The binder material for the overcoat layer preferably comprises a water-insoluble latex material, however, for purposes of the present invention, the layer may comprise water soluble materials or combinations of water-insoluble and water soluble materials. Examples of applicable water soluble binder materials include ethylene acrylic acid, polyvinyl alcohol, gelatin, and the like. As stated previously, such an overcoat layer may include the crosslinkable materials as described.

One or more overcoat layers may be used in combination with other layers. Typically, each overcoat layer has a thickness of up to about 2 microns, and preferably between 1 and 1.5 microns. Such overcoat layers must allow sufficient image-providing material to be transferred to image-receiving layer to provide a photograph of the desired quality. Furthermore, since the overcoat layer(s) remain upon the image-receiving element after processing and separation from the photosensitive element, the overcoat layer(s) should not scatter visible light to any appreciable degree since the photograph will be viewed through such layer(s).

The crosslinkable materials which may be used in the overcoat layers include materials which are substantially non-crosslinked prior to processing, but upon contact with the borate compound within the processing composition previously described, undergo crosslinking under processing conditions to form a hydrogel. Although many materials are crosslinkable by reaction with the subject borate compound under processing conditions, specific examples of such materials include polymers having hydroxyl groups, preferably vicinal 1,2 or 1,3-hydroxyl groups such as polyvinyl alcohol, and various copolymers of vinyl alcohol. Additional examples of such crosslinkable materials include alginate, Kelzan, mannose gums, e.g. guar, sugars such as mannitol, etc. Such overcoat layers may also include other additives including surfactant materials which enhance the fluid stability of the coating fluid, function as a coating aid and/or provide surface lubrication to the layer after separation of the image-receiving and photosensitive elements.

The opaque support 38 can comprise a number of materials as described with respect to support 12.

In addition to the image-receiving layer 18 and overcoat layer(s) 20, the polymeric acid layer 14 and timing layer 16 may also include the crosslinkable materials as described. By crosslinking the acid and/or timing layers during processing, the resulting image-receiving element is rendered more durable and less likely to be damaged by water.

Although the photographic film unit of the invention has been described in detail with respect to the preferred embodiments illustrated in FIGS. 1 and 2, it should be noted that other embodiments may be provided. For example, the diffusion transfer photographic film unit described in Japanese patent application S61-252685, filed Oct. 23, 1986, is formed by placing a photosensitive element on a white supporting structure which is made up of at least: a) a layer having a neutralizing function; b) a pigment-receiving layer; and c) a peelable layer. The photosensitive element includes at least one silver halide emulsion layer associated with an image dye-providing material, an alkaline developing substance containing a light-shielding agent and a transparent cover sheet. The crosslinking material of the present invention may be included within the image-receiving layer and/or an overcoat layer coated thereover (i.e. between the image-receiving layer and the peelable layer. Furthermore, the borate compounds of the present invention may be incorporated within the processing composition of the Japanese reference in order to crosslink the image-receiving layer and/or an overcoat layer during processing and reduce the period of time that the image-receiving element remains wet, or tacky, after separation. Similarly, the subject invention may also be used in a peel apart film unit as described in U.S. Pat. No. 5,023,163.

As noted previously, the photographic diffusion transfer film unit of the invention includes black and white photographic film units. In such embodiments, a photosensitive element including a photosensitive silver halide emulsion is exposed to light and subject to an aqueous alkaline solution comprising a silver halide developing agent and a silver halide solvent. The developing agent reduces exposed silver halide to metallic silver and the solvent reacts with unreduced silver halide to form a soluble silver salt complex. This soluble silver salt complex migrates to an image-receiving element. The image-receiving element typically comprises a support and an image-receiving layer including a silver precipitating material wherein the soluble silver salt complex is precipitated or reduced to form a visible silver black and white image. The binder material for the overcoat layer in black and white embodiments should be permeable to the photographic alkaline processing fluid and to complexed silver salt which transfers to the image-receiving layer to provide an image. Examples of such black and white photographic film units are disclosed in U.S. Pat. Nos. 3,567,442; 3,390,991; and 3,607,269 and in E. H. Land, H. G. Rogers, and V. K. Walworth, in J. M. Sturge, ed., *Neblette's Handbook of Photography and Reprography,* 7th ed., Van Nostrand Reinhold, New York, 1977, pp. 258–330.

The invention will now be described further in detail with respect to specific preferred embodiments by way of examples, it being understood that these are intended to be illustrative only and the invention is not limited to the materials, conditions, process parameters, etc. recited therein. All parts and percentages recited are by weight unless otherwise stated.

EXAMPLES

As an illustration of the subject invention, several example photographic film units were prepared—two CONTROLS and two TEST film units. All of the film units prepared comprised substantially identical image-receiving elements, photosensitive elements, and processing compositions, as described below. However, the noted difference between the examples was that the two TEST film units included a small amount of sodium borate within their processing compositions, whereas the two CONTROL film units did not.

The image-receiving elements utilized in all of the example film units were prepared by coating the following layers in succession upon a white-pigmented polyethylene coated opaque support:

1. a polymeric acid-reacting layer at a coverage of about 24,219 mg/m$^2$, comprising 9 parts GANTREZ™ S-97 (a free acid of a copolymer of methyl vinyl ether and maleic anhydride available from the GAF Corp.), and 11 parts AIRFLEX™ 465 (a vinyl acetate ethylene latex available from the Air Products Co.);
2. a timing layer coated at a coverage of about 4575 mg/m$^2$ comprising a graft polymer including the following materials in the approximate relative ratios indicated in parenthesis: a copolymer of diacetone acrylamide (8.2) and acrylamide (1.1) grafted onto polyvinyl alcohol (1);
3. an image-receiving layer coated at a coverage of about 2960 mg/m$^2$ comprising: 2 parts of a copolymer comprising the following monomer units in:

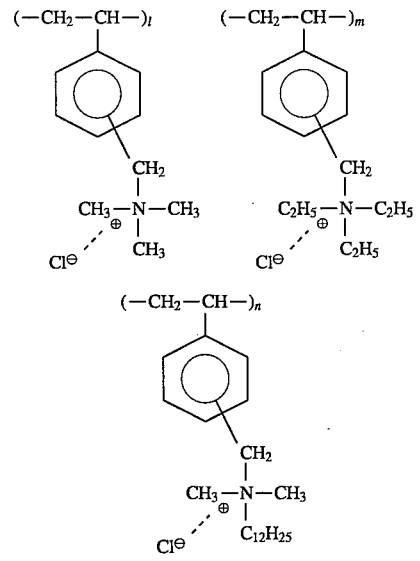

wherein l, m, and n represent the relative molar ratios of each monomer unit and are preferably 0.45, 0.45 and 0.1, respectively; and 1 part AIRVOL™ 165, (a super hydrolyzed polyvinyl alcohol material available from the Air Products Co.); and 4. an overcoat layer coated at a coverage of about 269 mg/m$^2$ of Goodrite™ K7200N (polyacrylic acid available from the B.F. Goodrich Co.).

The photosensitive element utilized in all of the example film units comprised an opaque subcoated polyethylene terephthalate photographic film base having the following layers coated thereon in succession:

1. a layer of sodium cellulose sulfate coated at a coverage of about 19 rag/m$^2$;
2. a cyan dye developer layer comprising about 960 mg/m$^2$ of the cyan dye developer represented by the formula

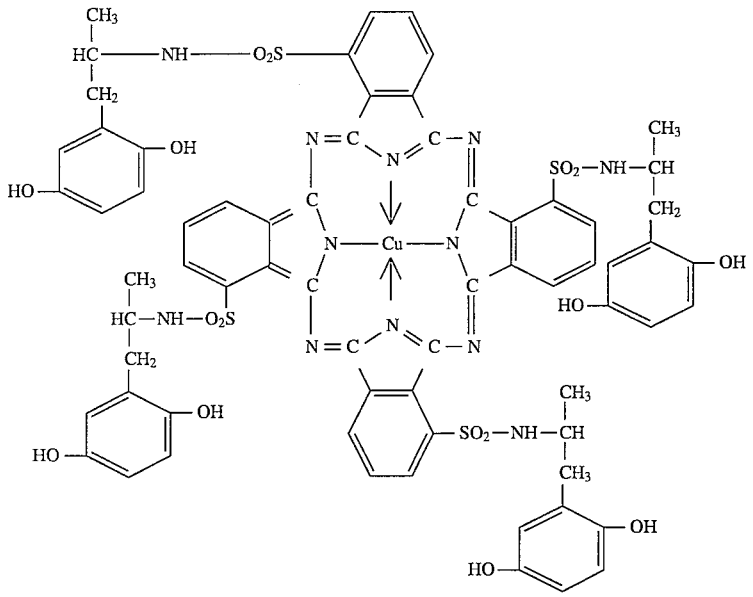

about 540 mg/m$^2$ of gelatin, about 12 mg/m$^2$ of sodium cellulose sulfate and about 245 mg/m$^2$ of phenyl norbornenyl hydroquinone (PNEHQ);

3. a red-sensitive silver iodobromide layer comprising about 780 mg/m$^2$ of silver (0.6 micron), about 420 mg/m$^2$ of silver (1.5 microns), about 720 mg/m$^2$ of gelatin and about 18 mg/m$^2$ of polyvinyl hydrogen phthalate;

4. an interlayer comprising about 2325 mg/m$^2$ of a copolymer of butyl acrylate/diacetone acrylamide/methacrylic acid/styrene/acrylic acid, about 97 mg/m$^2$ of polyacrylamide, about 124 mg/m$^2$ of dantoin and about 3 mg/m$^2$ of succindialdehyde;

5. a magenta dye developer layer comprising about 455 mg/m$^2$ of a magenta dye developer represented by the formula

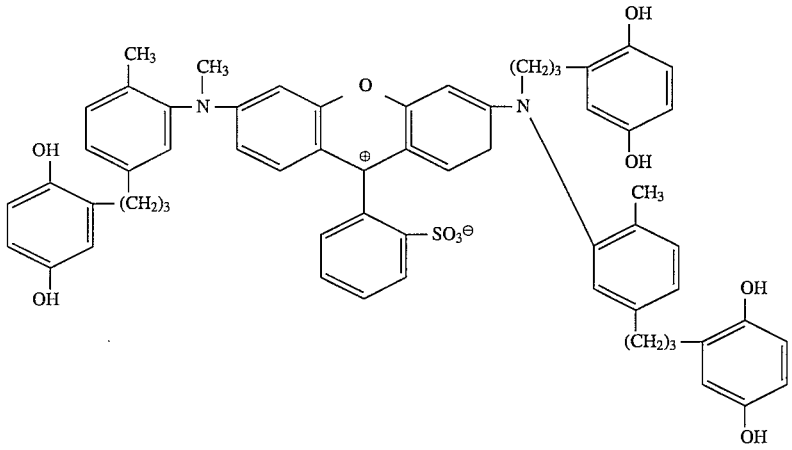

about 298 mg/m$^2$ of gelatin, about 234 mg/m$^2$ of 2-phenyl benzimidazole, about 14 mg/m$^2$ of phthalocyanine blue filter dye and about 12 mg/m$^2$ of sodium cellulose sulfate;

6. a spacer layer comprising about 250 mg/m$^2$ of carboxylated styrenebutadiene latex (Dow 620 latex), about 83 mg/m$^2$ of gelatin and about 2 mg/m$^2$ of polyvinyl hydrogen phthalate;

7. a green-sensitive silver iodobromide layer comprising about 540 mg/m$^2$ of silver (0.6 micron), about 360 mg/m$^2$ of silver (1.3 microns), about 418 mg/m$^2$ of gelatin and about 23 mg/m$^2$ of polyvinyl hydrogen phthalate;

8. a layer comprising about 263 mg/m$^2$ of PNEHQ, about 131 mg/m$^2$ of gelatin and about 4 mg/m$^2$ of sodium cellulose sulfate;

9. an interlayer comprising about 1448 mg/m$^2$ of the copolymer described in layer 4 and about 76 mg/m$^2$ of polyacrylamide and about 4 mg/m$^2$ of succindialdehyde;

10. a layer comprising about 1000 mg/m$^2$ of a scavenger, 1-octadecyl-4,4-dimethyl-2-[2-hydroxy-5-(N-(7-caprolactamido)sulfonamido] thiazolidine, about 405 mg/m$^2$ of gelatin, about 12 mg/m$^2$ of sodium cellulose sulfate and about 7 mg/m$^2$ of quinacridone red zeta;

11. a yellow filter layer comprising about 241 mg/m$^2$ of benzidine yellow dye, about 68 mg/m$^2$ of gelatin and about 3 mg/m$^2$ of sodium cellulose sulfate;

12. a yellow image dye-providing layer comprising about 1257 mg/m$^2$ of a yellow image dye-providing material represented by the formula

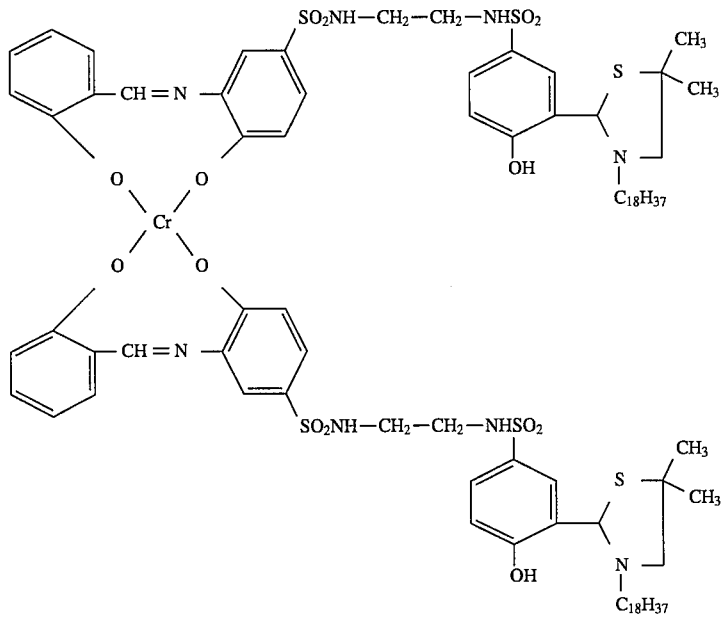

about 503 mg/m$^2$ of gelatin and about 20 mg/m$^2$ of sodium cellulose sulfate;

13. about 450 mg/m$^2$ of phenyl tertiarybutyl hydroquinone, about 100 mg/m$^2$ of 5-t-butyl-2,3-bis[(1-phenyl-1H-tetrazol-5-yl)thio]-1,4-benzenediol bis[(2-methanesulfonylethyl)carbamate]; about 250 mg/m$^2$ of gelatin and about 33 mg/m$^2$ of polyvinylhydrogen phthalate;

14. a blue-sensitive silver iodobromide layer comprising about 37 mg/m$^2$ of silver (1.3 microns), about 208 mg/m$^2$ of silver (1.6 microns), about 78 mg/m$^2$ of gelatin and about 7 mg/m$^2$ of polyvinyl-hydrogen phthalate;

15. a layer comprising about 500 mg/m$^2$ of an ultraviolet filter, Tinuvin (Ciba-Geigy), about 220 mg/m$^2$ of benzidine yellow dye, about 310 mg/m$^2$ of gelatin and about 23 mg/m$^2$ of sodium cellulose sulfate; and 16. a layer comprising about 300 mg/m$^2$ of gelatin and about 9 mg/m$^2$ of polyvinylhydrogen phthalate.

The example film units were prepared utilizing the image-receiving elements and photosensitive elements as described above. In each case, after photoexposure of the photosensitive element, the image-receiving element and the photosensitive element were arranged in face-to-face relationship, i.e. (with their respective supports outermost) and a rupturable container containing an aqueous alkaline processing composition was affixed between the image-receiving and photosensitive elements at the leading edge of each film unit such that the application of compressive pressure to the container would rupture the seal of the container along its marginal edge and distribute the contents uniformly between the respective elements. The chemical composition of the aqueous alkaline processing composition utilized for the processing of each film unit is set forth in Table I.

TABLE I

Processing Composition

| Component | Parts by Weight CONTROL | TEST |
|---|---|---|
| Potassium hydroxide | 7.08 | 7.08 |
| Hydroxy PMT (prarhydroxyphenyl mercapto tetrazole) | 0.005 | 0.005 |
| N-butyl-a-picolinium | 2.15 | 2.15 |
| 1-methylimidazole | 0.30 | 0.30 |
| 1,2,4-trizole | 0.36 | 0.36 |
| hypoxanthine | 1.00 | 1.00 |
| 3,5-dimethylpyrrazole | 0.25 | 0.25 |
| PMT (phenyl mercapto tetrazole) | 0.0006 | 0.0006 |
| sodium hydroxide | 1.44 | 1.44 |
| 2-(methylamino)ethanol | 0.15 | 0.15 |
| Guanine | 0.15 | 0.15 |
| Sodium Borate (available from Aldrich) | 0.00 | 1.00 |
| 5-amino-1-pentanol | 2.00 | 2.00 |
| Hydrophobically modified hydroxyethylcellulose (Natrosol Plus ™ available from Aqualon) | 3.39 | 3.39 |
| Sodium salt of paratoluene acid | 0.50 | 0.50 |
| Titanium dioxide | 0.20 | 0.20 |
| 6-methyl uracil | 0.55 | 0.55 |
| Water | Balance to 100 | |

As indicated in Table 1, the chemical composition of the processing composition was substantially identical among all the example film units, but for the presence of a small amount of sodium borate within the processing compositions of the TEST film units.

Each example film unit was exposed to a standard photographic sensitometric target and was processed at room temperature (about 20° C.) by spreading the processing composition between the image-receiving and photosensitive elements as they were brought into superposed relationship between a pair of pressure rollers having a gap spacing of about 0.0036". One CONTROL film unit and one TEST film unit were imbibed for a time period of about 90 seconds, the other CONTROL and TEST film units were imbibed for about 180 seconds, after which, the image-receiving element of each example film unit was separated from the remainder of the film unit to reveal the image. Following separation, each image-receiving element was tested for tack by measuring the time period after which tissue fibers would not adhere to the surface of the image-receiving element after being pressed thereagainst. Image density for red, green and blue wavelengths were also tested for each film unit. The results of the testing are provided in Tables II and III below.

TABLE II

| Sample | Tackiness Time (minutes) after 90 seconds inhibition | Image Density (Dmax) R | G | B |
|---|---|---|---|---|
| CONTROL | 14 | 2.32 | 2.40 | 1.90 |
| TEST | 0 | 1.79 | 2.00 | 1.69 |

TABLE III

| Sample | Tackiness Time (minutes) after 180 seconds imbition | Image Density (Dmax) R | G | B |
|---|---|---|---|---|
| CONTROL | 19 | 2.22 | 2.10 | 1.79 |
| TEST | 0 | 2.49 | 2.33 | 1.98 |

As indicated by the test data provided in Tables II and III, the TEST film units which included a crosslinkable (i.e. polyvinyl alcohol) material within the image-receiving layer and a borate compound (i.e. sodium borate) within the processing composition, were essentially tack-free upon peeling. In comparison, the CONTROL film elements which did not include a borate compound within the processing composition took a significant amount of time to become dry and tack-free.

Although the invention has been described in detail with respect to various preferred embodiments thereof, those skilled in the art will recognize that the invention is not limited thereto but rather that variations and modifications can be made which are within the spirit of the invention and the scope of the appended claims.

What is claimed is:

1. A diffusion transfer photographic film unit wherein an image-receiving element is adapted to be separated from a photosensitive element after photographic processing, said film unit comprising:

a photosensitive element comprising a support carrying at least one silver halide emulsion;

an image-receiving element arranged in superposable relationship with said photosensitive element, said image-receiving element comprising in sequence: a support, an image-receiving layer and optionally an overcoat layer, wherein at least one of said image-receiving layer and said overcoat layer includes a crosslinkable material which can be crosslinked by a borate compound during photographic processing, provided that said image-receiving layer includes said crosslinkable material when said overcoat layer is not present and at least one of said image-receiving layer and said overcoat layer includes said crosslinkable material when said overcoat layer is present; and means for providing an aqueous alkaline processing composition to said photosensitive element and said image-receiving element during photographic processing, said aqueous alkaline processing composition including a borate compound for crosslinking said crosslinkable material of said image-receiving element during processing.

2. A photographic film unit as defined in claim 1 wherein said borate compound is represented by the formulae:

(a) $H_3BO_3$; or (b) $xM_2O \bullet yB_2O_3 \bullet zH_2O$ wherein M represents a monovalent cation, x and y each represents a positive integer, and z represents 0 or a positive integer.

3. A photographic flint unit as defined in claim 1 wherein said borate compound is a member selected from the group consisting of boric acid, sodium borate and potassium borate.

4. A photographic film unit as defined in claim 1 wherein said crosslinkable material comprises a polymer having hydroxyl groups capable of reacting with said borate compound during photographic processing to form a hydrogel.

5. A photographic film unit as defined in claim 4 wherein said crosslinkable material comprises a polymer including vicinal hydroxyl groups.

6. A photographic film unit as defined in claim 4 wherein said crosslinkable material is a member of the group consisting of polymers of vinyl alcohol and mannose gums.

7. A photographic film unit as defined in claim 1 wherein said image-receiving layer includes said crosslinkable material.

8. A photographic film unit as defined in claim 7 wherein said image-receiving layer comprises a mordant material and a binder material and said binder material is said crosslinkable material.

9. A photographic film unit as defined in claim 7 wherein said image-receiving layer comprises a mordant material which is said crosslinkable material.

10. A photographic film unit as defined in claim 1 wherein said overcoat layer is present and includes said crosslinkable material.

11. A photographic film unit as defined in claim 10 wherein said overcoat layer comprises colloidal silica particles and binder material.

12. A photographic film unit as defined in claim 1 wherein said image-receiving element further includes a strip-coat layer.

13. A photograph film unit as defined in claim 12 wherein said strip-coat layer includes said crosslinkable material.

14. A photographic film unit as defined in claim 13 wherein said crosslinkable materials in said strip-coat layer is a mannose gum.

15. A photographic film unit as defined in claim 14 wherein said mannose gum is carboxymethyl guar.

16. A photographic film unit as defined in claim 1 wherein said image-receiving element further includes a polymeric acid-reacting layer and a polymeric timing layer.

17. A photographic film unit as defined in claim 1 wherein said photosensitive element comprises a blue sensitive silver halide emulsion layer in association with a yellow image dye-providing material, a green-sensitive silver halide emulsion layer in association with a magenta image dye-providing material and a red-sensitive silver halide emulsion layer in association with a cyan image dye-providing material.

18. A method for forming a diffusion transfer image comprising the steps of:

exposing a photosensitive element comprising a support carrying at least one silver halide emulsion to an imagewise pattern of radiation;

providing an image-receiving element in superposed relationship to said photosensitive element, said image-receiving element comprising in sequence: a support, an image-receiving layer, and optionally an overcoat layer, wherein at least one of said image-receiving layer and said overcoat layer includes a crosslinkable material which can be crosslinked by a borate compound, provided that said image-receiving layer includes said crosslinkable material when said overcoat layer is not present and at least one of said image-receiving layer and said overcoat layer includes said crosslinkable material when said overcoat layer is present;

applying an aqueous alkaline photographic processing composition to said photosensitive element and said image-receiving element, wherein said processing composition includes a borate compound for crosslinking said crosslinkable material of said image-receiving element during processing; and separating said image-receiving element from said photosensitive element following processing.

19. The method as defined in claim 18 wherein said borate compound is represented by the formulae:

(a) $H_3BO_3$; or (b) $xM_2O \bullet yB_2O_3 \bullet zH_2O$ wherein M represents a monovalent cation, x and y each represents a positive integer, and z represents 0 or a positive integer.

20. The method as set forth in claim 18 wherein said borate compound is a member selected from the group consisting of boric acid, sodium borate and potassium borate.

21. The method as defined in claim 18 wherein said crosslinkable material comprises a polymer having hydroxyl groups which react with said borate compound during processing to form a hydrogel.

22. The method as defined in claim 21 wherein said crosslinkable material comprises a polymer including vicinal hydroxyl groups.

23. The method as set defined in claim 21 wherein said crosslinkable material is a member of the group consisting of polymers of vinyl alcohol and mannose gums.

24. The method as defined in claim 18 wherein said image-receiving element further includes a strip-coat layer.

25. The method as defined in claim 24 wherein said strip-coat layer includes a material which is crosslinkable by said borate compound.

26. The method as defined in claim 25 wherein said crosslinkable material in said strip-coat layer is a mannose gum.

* * * * *